US011286600B2

(12) United States Patent
Lampaert et al.

(10) Patent No.: US 11,286,600 B2
(45) Date of Patent: Mar. 29, 2022

(54) TUFTING MACHINE AND METHOD FOR OPERATING A TUFTING MACHINE

(71) Applicant: Vandewiele NV, Kortrijk (BE)

(72) Inventors: Vincent Lampaert, Vichte (BE); Koen Callewaert, Tielt (BE); Frank Marijsse, Kortrijk (BE); Liesbeth Luyckx, Kortrijk (BE); Frank Shanley, Lancashire (GB)

(73) Assignee: Vandewiele NV, Marke (BE)

( * ) Notice: Subject to any disclaimer, the term of this patent is extended or adjusted under 35 U.S.C. 154(b) by 51 days.

(21) Appl. No.: 16/771,556

(22) PCT Filed: Dec. 6, 2018

(86) PCT No.: PCT/EP2018/083875
§ 371 (c)(1),
(2) Date: Jun. 10, 2020

(87) PCT Pub. No.: WO2019/115362
PCT Pub. Date: Jun. 20, 2019

(65) Prior Publication Data

US 2021/0180230 A1 Jun. 17, 2021

(30) Foreign Application Priority Data

Dec. 13, 2017 (GB) ..... 1720794
Jan. 11, 2018 (GB) ..... 1800486

(51) Int. Cl.
*D05C 15/30* (2006.01)
*D05C 15/18* (2006.01)
(Continued)

(52) U.S. Cl.
CPC ..... *D05C 15/30* (2013.01); *D05C 15/18* (2013.01); *D05C 15/20* (2013.01); *D05C 15/34* (2013.01); *D10B 2503/04* (2013.01)

(58) Field of Classification Search
CPC ... D05C 5/18; D05C 5/20; D05C 5/26; D05C 5/28; D05C 5/30; D05C 5/34; D05C 5/02; D10B 2503/04; D05B 19/02; D05B 19/12
See application file for complete search history.

(56) References Cited

U.S. PATENT DOCUMENTS

2003/0140830 A1 7/2003 Pokrishevsky et al.
2009/0205547 A1* 8/2009 Hall ..... D05C 15/36 112/80.41

(Continued)

OTHER PUBLICATIONS

The Search Report prepared by the Intellectual Property Office of Great Britain dated Jul. 11, 2018 for priority patent application No. GB1800486.1; 3 pages.

(Continued)

*Primary Examiner* — Nathan E Durham
(74) *Attorney, Agent, or Firm* — Smith Gambrell & Russell LLP

(57) ABSTRACT

A pattern data processing system configured to determine and compensate for any points of entanglement between different yarns. A point of entanglement is defined as a point where the yarn from one needle crosses and traps the yarn from another needle on the back face of the backing medium. The pattern data processing system is configured to calculate the additional length of back stich caused by each point of entanglement by subtracting an ideal back stich length, calculated as the path which would have been taken by the yarn had it not been entangled in another yarn, from an actual yarn path, calculated as the actual length of the entangled yarn. A controller is configured to include in the amount of yarn fed by a respective yarn feed mechanism for each stitch an amount equivalent to the additional length of (Continued)

back stitch. The invention also includes a tufting machine and method of operating the tufting machine with the pattern data processing system.

2 Claims, 9 Drawing Sheets

(51) Int. Cl.
*D05C 15/20* (2006.01)
*D05C 15/34* (2006.01)

(56) References Cited

U.S. PATENT DOCUMENTS

| | | | | |
|---|---|---|---|---|
| 2009/0260554 | A1* | 10/2009 | Hall ..... | D05C 15/18 112/80.4 |
| 2014/0283724 | A1 | 9/2014 | Frost et al. | |
| 2016/0069010 | A1 | 3/2016 | Frost et al. | |
| 2017/0204546 | A1 | 7/2017 | Padgett et al. | |

OTHER PUBLICATIONS

The International Search Report prepared by the European Patent Office as International Search Authority dated Feb. 18, 2019 for the parent PCT application, PCT/EP2018/083875; 3 pages.

* cited by examiner

TUFTING MACHINE AND METHOD FOR OPERATING A TUFTING MACHINE

The present invention relates to a tufting machine and a method of operating the tufting machine. In particular, it is directed to a tufting machine and a method with enhanced control of the yarn feed in order to provide a more uniform pile height.

A uniform pile height is desirable in tufting machines as it allows the tufting machine to produce a carpet which is as avoids the formation of unduly short tufts which then become essentially invisible in the finished carpet.

The invention applies in particular, to a tufting machine as defined by the pre-characterising clause of claim 1.

Such a machine has a sliding needle bar which will slide laterally with respect to a tufting direction in which a backing medium is fed through the tufting region. The machine also has a stitch selection mechanism which means that, as the sliding needle bar slides across the backing medium, a controller may determine when the tuft presented by a particular needle is required by the pattern data at that position and uses that to form a tuft, while any needles which carry a colour not required by the pattern data at that position are not used for the tuft.

Such stich selection mechanisms are well known in the art and broadly fall into two categories.

Firstly, in a more traditional tufting machine, this is done by controlling the yarn tension. If a yarn of a non-required colour is presented to the backing medium, the needle carrying that yarn penetrates the backing medium and forms a tuft as usual. However, the yarn tension is briefly increased such that the tuft is either pulled out of the backing medium or is pulled low such that the tuft that it produces is not visible in the finished carpet.

The second approach is an individual needle control (ICN) machine such as that disclosed in GB2242914 and GB2385604. In these machines, the needle for a non-selected colour is not driven into the backing medium. Instead, the individual need (or group of needles) are latchable with respect to the needle bar. If the colour presented by a particular needle is not required for the pattern, the stitch selection mechanism simply does not operate the associated latching mechanism such that the needle is not latched to the needle bar and is therefore not reciprocated as the needle bar reciprocates. If the yarn is required by the pattern, the associated latch operates to couple the needle to the needle bar to allow the needle to provide a tuft.

The present invention is applicable to either type of stich selection mechanism.

A problem with these stitch selection mechanisms is that in between each location where a particular needle is required to form a tuft, the yarn extends across the back side of the backing medium. The sliding medium bar extends across a significant number of needle pitches such that there each back stitch extends to a considerable lateral extent, particularly where the yarn is not required in the pattern for some considerable distance. Further, there are typically somewhere between 2-6 different colours of needles of yarn involved in the pattern and all of these extend in different directions on the back stitch such that entanglement of the yarn is a common phenomenon leading to the back surface of the carpet looking extremely messy. This is not a problem in itself as the carpet is subsequently coated. However, this leads to other difficulties. In particular, the amount of yarn required for the back stitch stitch as calculated on the basis that there is a direct path between two adjacent tufts created by each respective needle. If a yarn is entangled, it is effectively anchored at a point off of the direct path and this will lengthen the path of the back stitch. However, because the amount of yarn fed is calculated based on the direct path, this means that there is a short fall in the yarn feed. As a result of this, the next tuft produced following a point of entanglement will be short by an amount approximately equivalent to half of the additional amount of yarn required to produce the back stitch for the entangled yarn. This will not be visible, or will at least be hard to see in the finished carpet.

As mentioned above, in a traditional tufting machine, the yarn for an non-required colour is either pulled out of the backing or is pulled low. Where the yarn is pulled low but not out of the backing medium for all stitches, the problem of entanglement does not arise as the yarn is anchored to the backing medium at each stitch position. However, where a significant proportion of the yarns are pulled out of the backing medium, the problem of entanglement arises as this forms "tails" of unattached yarn on the back side of the back of the backing medium. This is also a problem for the above mentioned ICN machines with the latching mechanism as these will form the same type of tails as a traditional machine will where all of the yarns are pulled out of the backing medium.

According to the present invention, such a tufting machine is characterised by the characterising features of claim 1.

The present invention takes a different approach in that it actively determine where a point of entanglement will occur and then takes this into account in the yarn feed.

As a first iteration, the controller may be arranged to calculate the points of entanglement based on the assumption that the path of each yarn from one tuft formed by a respective needle to an adjacent tuft formed by the same needle is the straight path. However, once this first iteration has been carried out and the points of entanglement have been calculated, a controller may then carry out a second iteration of the calculation taking into account that the yarn path from the tuft formed by one needle to an adjacent tuft formed by the same needle is deflected by virtue of the point of entanglement and may calculate further points of entanglement based on this non-straight path. Providing just the first iteration significantly improves upon the prior art where no compensation is provided for the points of entanglement such that this second iteration may not be necessary in practice.

Third and subsequent iterations may also be carried out but each iteration will generate a significant increase in the processing power required and the level of additional accuracy provided between the second and subsequent iterations diminishes rapidly with each further iteration.

A tufting machine and method for operating a tufting machine will now be described with reference to the accompanying drawings, in which.

Figure 1:
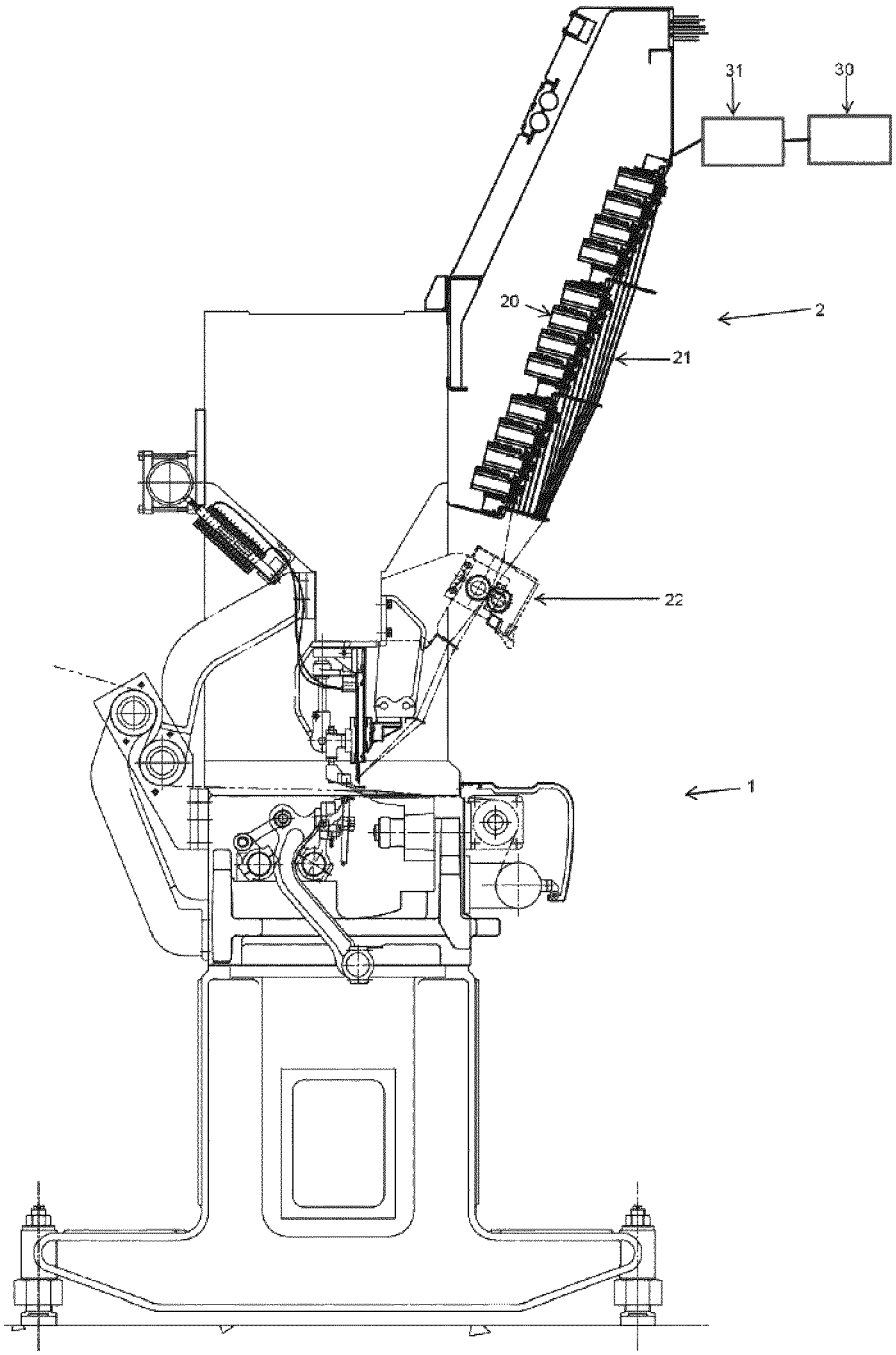
FIG. 1 is a schematic cross section of a tufting machine according to the present invention.
Figure 2:
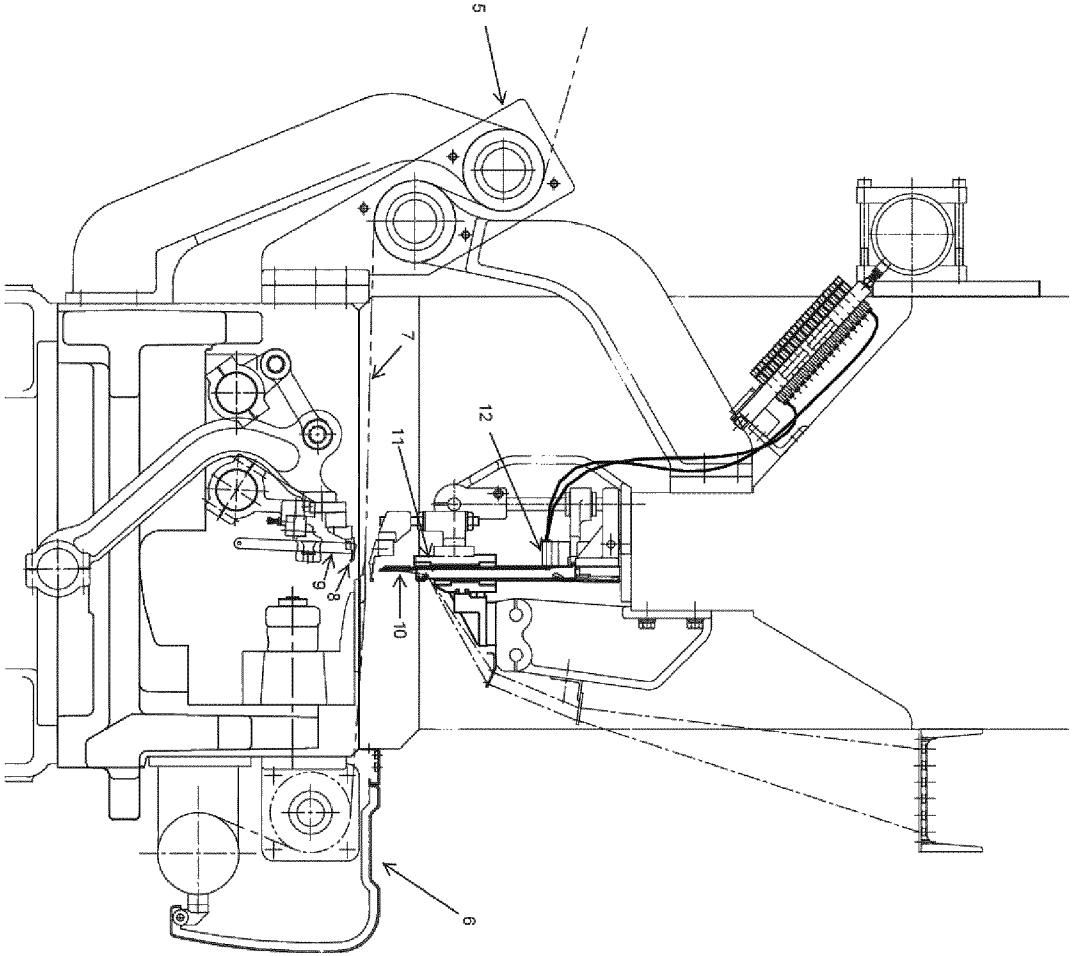
FIG. 2 is an enlarged view of a central portion of FIG. 1.

A tufting machine according to the present invention is shown in FIGS. 1 and 2. For the purposes the description, this consists of two main components namely the main tufting machine 1 forming the bulk of the tufting machine and the yarn feed mechanism 2 to feed the yarn to the main tufting machine 1.

The tufting machine 1 is based on an individual needle control (ICN) machine as such as a ColorTec.

In particular, it comprises a rear 5 and front 6 backing feed mechanisms to feed a backing medium 7 through the tufting machine. Beneath the backing material are a series of gauge parts including a series of hooks 8 and knives 9 which are arranged across the tufting machine in a direction perpendicular to the plane of FIGS. 1 and 2. A corresponding number of needles 10 are reciprocated by a needle bar 11 to which they are selectively latched by a latching mechanism 12 as described, for example, in GB2385604. As described to date, the tufting machine is a conventional ICN machine.

In such a machine, the needle bar 11 is reciprocated to form tufts and is moved laterally to selectively align needles with different coloured yarns at a particular position. A controller receives pattern data and, when a needle with the colour demanded by the pattern is in the appropriate position, the latching mechanism 12 will operate to couple that needle 10 to the needle bar 11 such that, as the needle bar reciprocates, the yarn is driven through the backing medium 7. The loop of yarn formed by that needle is picked up by the adjacent hook 8 to form a loop of yarn which is then cut by the knife 9 in order to form a cut pile carpet. This is how a conventional ICN machine operates. The machine may also be provided with a looper in place of the hook 8 and with no knife in order to produce a loop pile carpet, although ICN machines are not generally used in this way.

As described so far, the ICN is a known arrangement. In a conventional ICN machine a yarn latch is associated with each needle to pull the yarn down with a selected needle. The present invention applies to such a conventional ICN machine. However, it also applies to a modified ICN machine as shown in FIGS. 1 and 2 and these modifications are described below. Such a modified ICN machine is subject of our co-pending application GB 1720794.5.

Instead of providing latches on the needles to pull the yarn down, the yarn in the modified ICN machine is fed by an actively driven yarn feed mechanism 2. This comprises a series of server motors 20 each of which feeds an individual yarn 21 to a respective needle. As shown in FIG. 1, a pair of puller rolls 22 are provided via which the yarns pass in order to equalise the tension in the yarns coming from various different heights as is apparent from FIG. 1. The puller rolls are depicted in broken lines in FIG. 1 to signify that they are considered optional and are, in fact, not used in the preferred embodiment. Instead, the job of controlling the yarn tension is now done by the yarn feed mechanism 2.

In some situations described below, it is necessary to operate the servo motors 20 in reverse. This can create slack yarn between the creel 30 and the yarn feed mechanism 2. If the slack reaches unacceptable levels, a compensation system 31 can be provided between the creel 30 and yarn feed mechanisms 2. This is in the form of a weight for each of the yarns which will effectively hang from the yarn and hence take up any slack if the respective servo motor 20 is driven in reverse.

This will now be described with reference to FIGS. 3 to 8. All of FIGS. 3 to 8 depict two needle strokes starting from top dead centre. All of them show the yarn which is fed in order to form a tuft as a dotted line. They also show the yarn which is fed as a backing stitch compensation in the smaller dashed lines. Backing stitch compensation happens in the case of a sliding needle bar where a needle is slid laterally across the machine from one position to another. Under these circumstances, the yarn feed mechanism has to feed additional yarn to the needle in order to compensate for the fact that it has moved, otherwise a needle will pull on the yarn as it is moved thereby increasing the yarn tension. The sum of the yarn feed to form the tuft and the yarn required for the backing stitch compensation represents the total yarn feed fed by each server motor of the yarn feed controller and is represented by the large dashed line in FIGS. 3 to 8.

Figure 3:
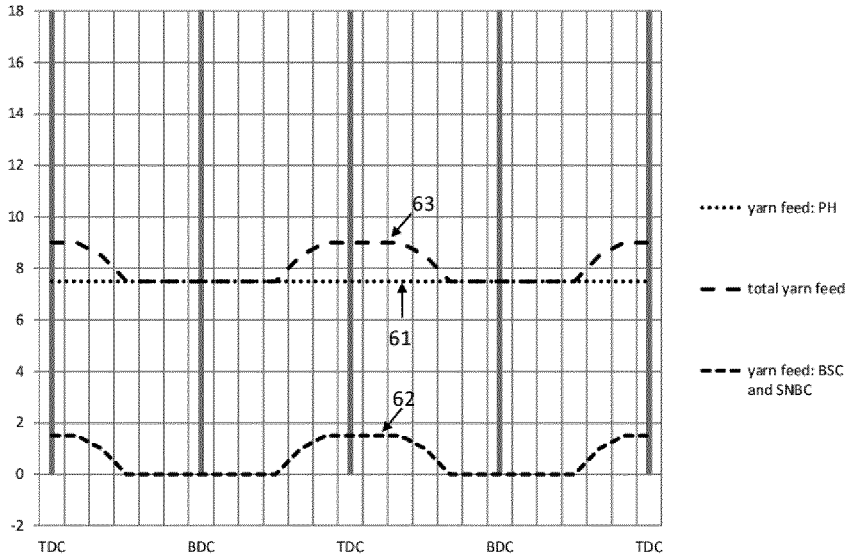
FIG. 3 is a graphical representation of the rate of yarn feed in millimetres through two strokes of a tufting needle in accordance with a conventional yarn feed profile.

FIG. 3 shows the yarn feed profile for a conventional yarn feed mechanism. As can been in FIG. 3, the yarn required to feed the pile height 61 is constant throughout the stroke while a small amount of yarn is fed 62 in the last half of the up-stroke and the first half of the down-stroke as backing stitch compensation. The total yarn feed is shown as 63.

Figure 4:
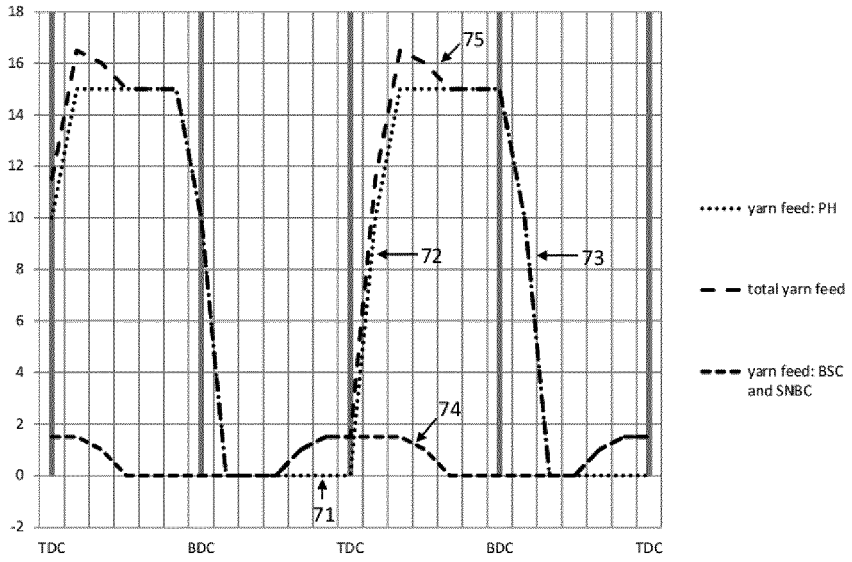
FIG. 4 is a view similar to FIG. 3 for a selected needle of an enhanced yarn feed profile.

By complete contrast, in FIG. 4 shows no yarn feed for the tuft is fed for most of the down stroke as depicted by reference numeral 71. However, at top dead centre the yarn feed ramps up rapidly as depicted by 72 in order to feed as much yarn as possible by bottom dead centre. At bottom dead centre, the yarn feed tails off rapidly as depicted by 73 and before the first half of the down-stroke has been completed, the yarn feed for the tuft is stopped entirely. Superimposed on this is the same profile 74 from the the back stitch compensation, providing a total yarn feed 75 which is still dominated by the feeding of the yarn for the tuft in the first half of the stroke. This is done because, all of the yarn required to form a tuft is consumed on the down stroke of the needle and, as the needle undergoes its upstroke, the yarn has to slide through the needle to leave the yarn in place for the tuft.

Figure 5:
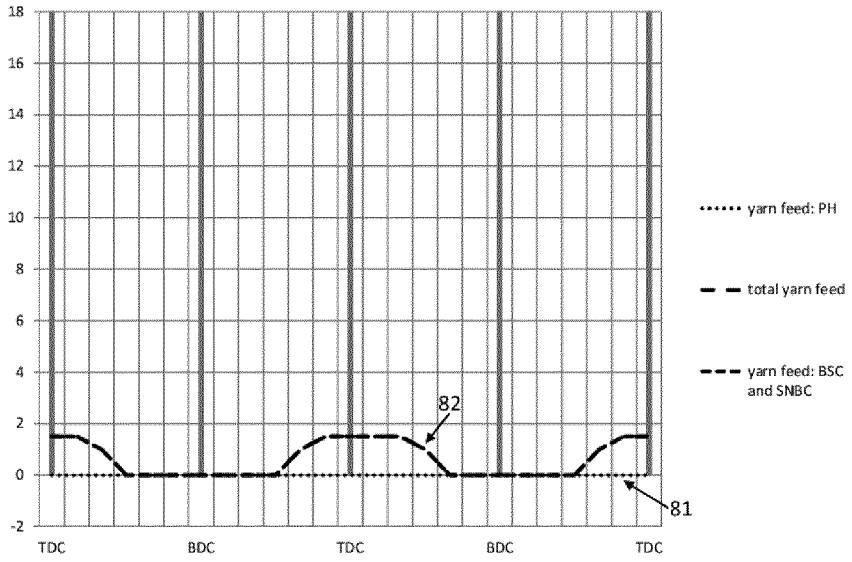
FIG. 5 is a view similar to FIG. 4 showing the yarn feed profile to a non-selected needle.

FIG. 5 shows the situation where a needle is not selected and hence the yarn feed for the tuft 81 remains at zero while the yarn feed for the back stitch compensation 82 is as before and equates to the total yarn feed.

Figure 6:
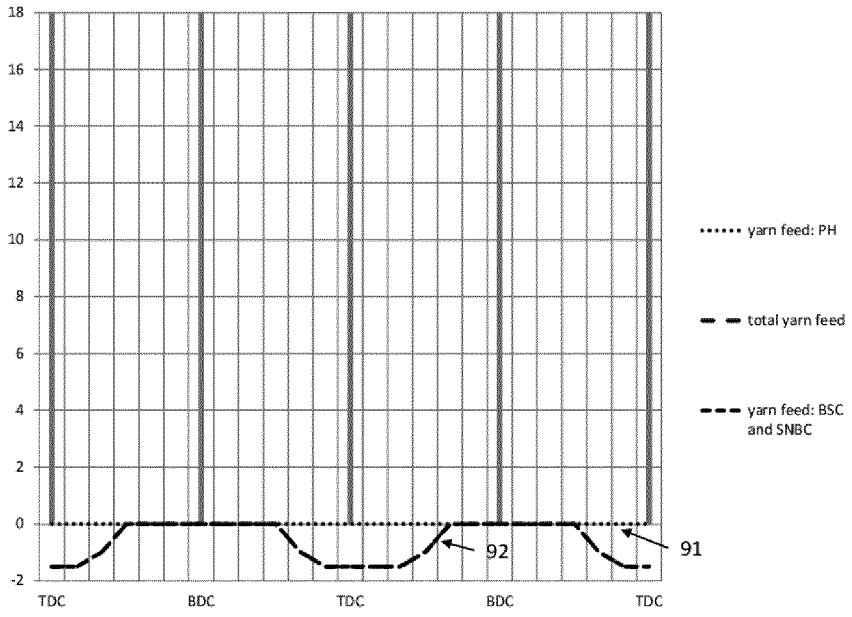
FIG. 6 is a view similar to FIG. 5 showing the yarn feed profile to a non-selecting needle under different circumstances.

FIG. 6 represents a slightly different situation where a needle is not selected such that the yarn required for the tuft 91 remains at zero. If, for a non-selective needle, the distance between a new stitching point and the last stitch is smaller than the distance between the previous stitching point and the last stitch, an excess of yarn will be present and needs to be recovered. In this situation, the backing stitch compensation feed becomes negative 9 indicating that the individual server motor of the yarn feed system 2 is operating in reverse to recover yarn.

Figure 7:
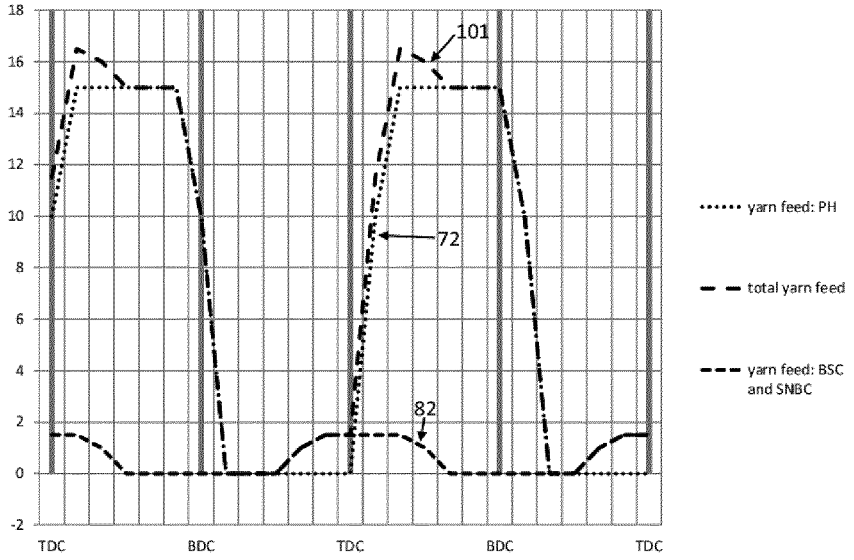
FIGS. 7 and 8 are views similar to FIGS. 4 to 6 showing variations in the yarn feed profile for the formation of a first stitch or where a needle has not been selected for some time.
Figure 8:
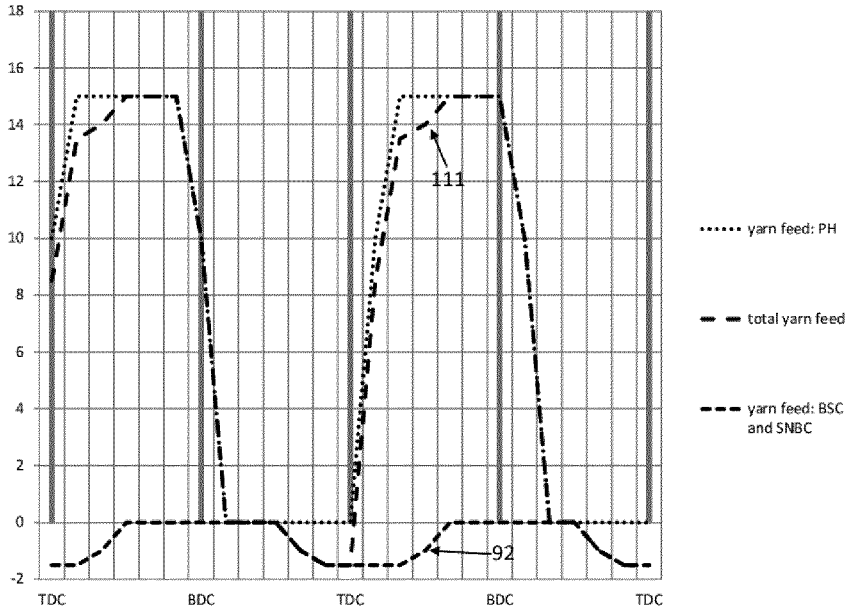

FIGS. 7 and 8 depict the yarn feed to a selected needle either where the needle is reciprocated for the first time or where the needle has not been reciprocated for a number of strokes.

FIG. 7 effectively corresponds to FIG. 5 in terms of the back stitch compensation with the yarn feed for the tuft from FIG. 4, while FIG. 8 is a combination of the negative yarn feed according FIG. 6 with the yarn feed for the tuft of FIG. 4. FIG. 7 represents the situation where the distance between a new stitching point and the last stitch is greater than the distance between the previous stitching point and the last stitch such that additional yarn 101 is fed while FIG. 8 represents a situation where the distance between a new stitching point (where the needle is not selected) and the last stitch is smaller than the distance between the previous stitching point and the last stitch such that some yarn 111 is held back.

The above yarn feed profiles provides a superposition of the yarn feed needed to compensate for the backing stitch and the yarn feed needed to form the pile height with the desired height. This is done by concentrating the yarn feed in the first half of the cycle as described above. This provides a benefit that the yarn remains more stretched during the entire stitch cycle and slack can be avoided.

The above description relates to a modified ICN machine and the manner in which the yarn is fed to such a machine. This is the subject of GB 1720794.5. As mentioned above, the present invention is also applicable to a conventional ICN machine. It is also applicable to a conventional tufting machine which uses the control of yarn tension rather than a latching mechanism to selectively produce each tuft. In all cases, on the back side of the backing medium, the yarns follow a complex path and will frequently become entangled. The manner in which this is dealt with will now be described with reference to FIGS. 9 to 15. It should be noted that the explanation is common to the above described modified ICN machine, the conventional ICN machine and the conventional non-ICN machine in which non-selected tufts are pulled out of the backing medium as, in all cases, the yarns between adjacent selected stitches on the back side of the backing medium will follow the same path.

Before describing the new yarn feed in detail, the nomenclature being used in FIGS. 9 to 15 will now be described with reference to FIG. 9.

The figures essentially represent a schematic plan of the backing medium 7. The backing medium 7 is fed through the tufting machine the direction B. The needle bar 11 (not shown in FIGS. 9 to 15) reciprocates in a transverse direction N.

FIGS. 9 to 15 depict a carpet comprising four colours of yarn. However, the principles described applicable to any design with multiple yarn colours.

In the drawings, each different yarn is shown with different shading. For the purposes of this explanation, the colours described will be referred to as red 200 depicted by vertical shading, yellow 201 depicted by cross-hatched shading, blue 202 depicted by continuous shading and white 203 depicted by the absence of shading. It will be understood, however, that any colours can be used. Further, although four separate colours are described, the colours may be present in any permutation such that they may, for example, be a group comprising two yarns of the same colour and two further yarns of each of a different colour. Such needle threading arrangements are well known in the art and will not be described further here.

Figure 9:
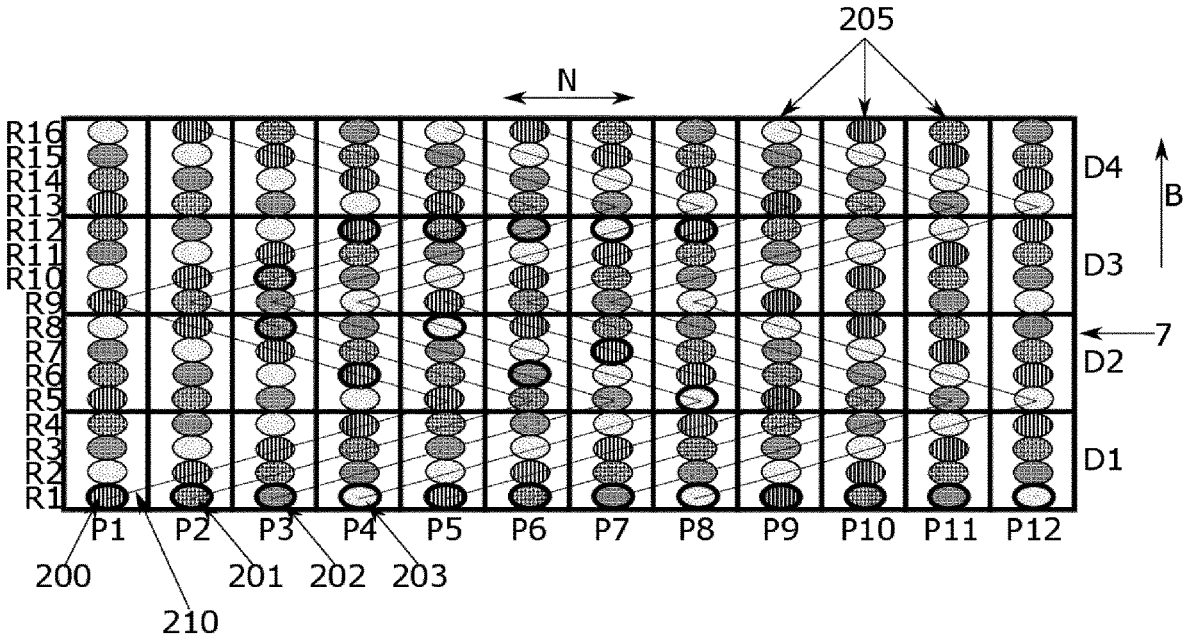
FIGS. 9 to 15 are schematic diagrams showing the positioning of stitches formed in the backing medium and provide a step-by-step explanation of how the yarn compensation for untangled back stitches is determined.

With reference to FIG. 9, each rectangle 205 in the array corresponds to a different stitch position. This corresponds to the pattern data. In the pattern, there are a number of pattern rows D1 to D4 and a number of stitch positons P1 to P12 across the backing. The pattern will require that a stitch of a particular colour and having a particular pile height be tufted at each position 205 and the tufting machine control system will operate to ensure that that particular colour is tufted at that particular position.

The needle bar starts in the position R1 shown on the left hand side of FIG. 9. As shown, the needle bar threaded as shown in FIG. 9 has twelve needles, although, in practice, the needle bar will be much longer and effectively repeat these twelve positions across the width of the tufting machine. Starting from the left hand side, the first needle is threaded with a red yarn 200 at position P1, the adjacent needle is threaded with a yellow yarn 201 at position P2, the next needle is threaded with a blue yarn 202 at position P3 and the next yarn is threaded with a white yarn 203 at position P4. The arrangement of four positions P1 to P4 is repeated for position P5 to P8 and again for positions P9 to P12 as is apparent from FIG. 9. The distance between adjacent positions is known as the pitch of the tufting machine and represents the gap between adjacent needles.

On the first stroke of the needle bar 11, the above mentioned colours are presented at the above mentioned positions. In the case of an ICN machine, if that particular colour is required at that particular position, its needle is latched to the needle bar and the needle penetrates the backing medium 7 to form a tuft of the appropriate colour. In the case of a traditional tufting machine, all of the needles penetrate the backing medium 7, but if the colour is not required, the yarn tension is increased to pull an unwanted colour out of the backing medium 7.

Having made the first stroke, the backing medium 7 is advanced so that the needle bar lines up with position R2. At the same time, the needle bar moves one position to the right following the path depicted by the dotted lines in FIG. 9. Thus, in position R2 the needle with the red yarn 200 that was initially at position 1 moves to position 2 while the yellow yarn 201 was at position P2 moves to position P3 and so on. This procedure is repeated so that each of the yarn colours is presented at each position 205 and in this case, this is shown from positons R1 to R4 allowing the controller to select the appropriate colour to form the tuft required for pattern row D1 as described above.

The needle bar makes its final step to the right so that, for example, the needle with the red yarn 200 that began at position P1 moves to position P5. The needle bar then reverses and moves four steps to the left following the line 210 in FIG. 9, this is repeated across the machine and this same cycle then repeats as the backing medium 7 is advanced. The figures depict a jump of a single pitch between each position of the needles in order to simplify the explanation. However, the needle bar may follow a more complex path in which it jumps more than one pitch between each row or even jumps by a fraction of the pitch. Such needle bar movements are well known in the art and will not be described further here.

Having described the notation used in FIGS. 9 to 15, the operation of the present invention will now be described with reference to FIGS. 10 to 15. For simplicity, the explanation is provided in relation to the blue yarn 202 and an adjacent needle with a white yarn 203 in relation to three needle positions P3 to P8. In each of FIGS. 10 to 16, the colour which has been selected for a particular position 205 is shown with a bold outline.

Thus, the pattern data calls for a blue yarn 203 at position P4 of row D1, a white yarn at position P5 of row D1 and a blue yarn at position P6 of row D1. White yarns are also required in position P5 for rows D2, D3 and D4 while a blue yarn is required in position P6 of row D3.

Figure 10:
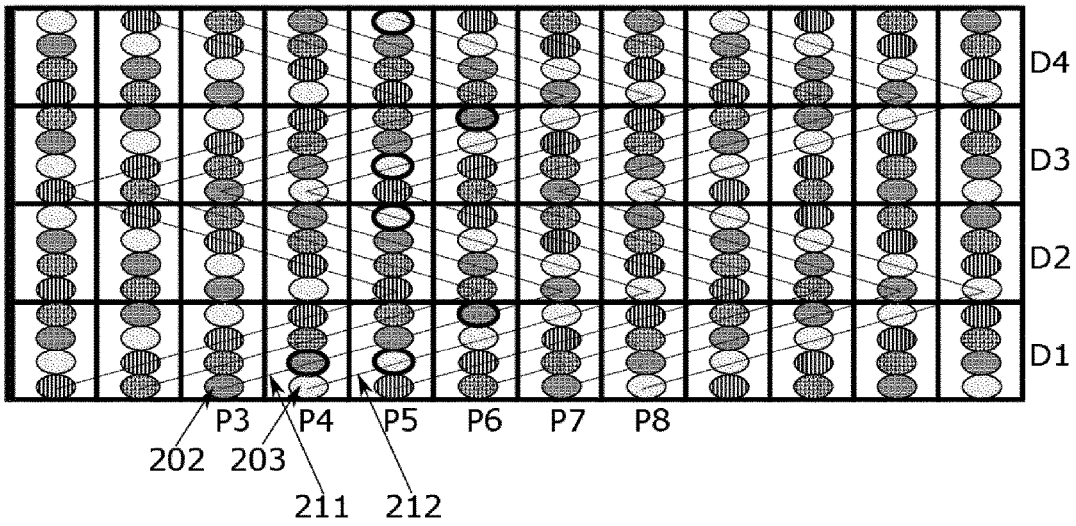

As can be seen, for example, from FIG. 10, the needle with the blue yarn 202 moves through positions P3 to P7 and back along path 211 while the needle with the white yarn 203 moves between positions P4 to P8 and back along path 212. The only explanations in which these yarns are selected to form a tuft are the ones mentioned above. In all other positions where no yarn is shown in bold, a different colour yarn will be chosen to form the tuft. This has not been shown and is not described for the sake of clarity.

Figure 11:
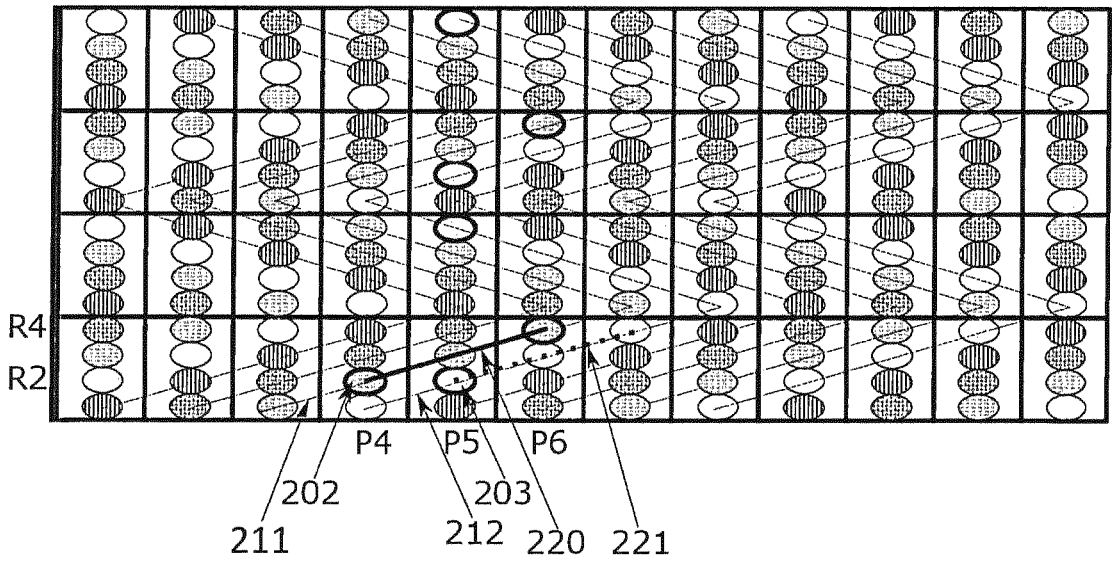

With reference to FIG. 11, the path followed by the needle with the blue yarn 202 follows the path 211 as the backing material moves in the direction B and the needle bar 11 reciprocates in the direction N, while the needle with the white yarn 203 follows the parallel path 212.

At row R2, the needles at position P4 and P5 are selected to form tufts such that a blue tuft 202 is formed at position P4 and a white tuft 203 is formed at position P5. The needle bar then moves to row R3 where no tufts of significance to this explanation are formed and subsequently onto positon R4 where a blue tuft is formed at position P6. As a result of this, the path 220 shown in a bold line in FIG. 11 of the blue yarn along the backside of the backing medium is a straight line which is anchored between the two stitches (at R2, P4 and R4, P6). At the same time, the path for the white yarn 221 is shown in dotted line because, as no white stitch is formed in row R4, the white yarn is not anchored at this point. This notation is followed in subsequent drawings, where a bold line denotes a fixed path anchored at both ends, while a dotted line denotes a path which is not yet anchored at one end and is therefore free to rotate about its anchored end.

The needle bar follows the zigzag paths 211 and 212 through a successive position R5 to R7 without forming any further tufts.

Figure 12:
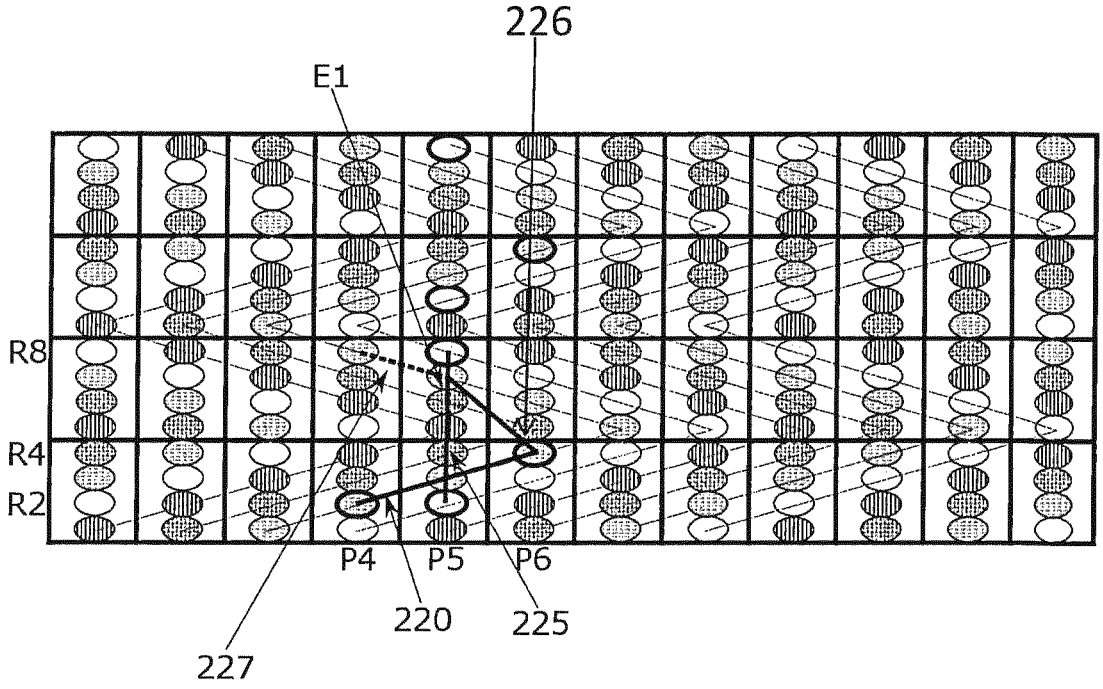

The next tuft on note is formed in position R8 by the needle with the white yarn 203 as depicted in FIG. 12. As mentioned above with relation to FIG. 11, the white yarn was not anchored to the backing medium. As the needle with this yarn follows the zigzag path 211, yarn swings anti clockwise, anchored by the white stitch at position P5, R2. When reaching row R8 in which a subsequent white stitch 203 is formed, the yarn path 225 for the white yarn on the backside of the backing medium is a straight line extending in the direction B as shown in FIG. 12.

While this is going on, the needle for the blue yarn follows the zigzag path 211 while the blue yarn itself on the backside of the backing medium is anchored at position P6, R4, which is then dragged to the left as shown in FIG. 12 from this position such that it is trapped under the white yarn on path 225. The blue yarn is therefore effectively anchored between the stitch at position P6, R4 at the point of entanglement E1 where it is trapped by the white yarn on path 225.

Figure 13:
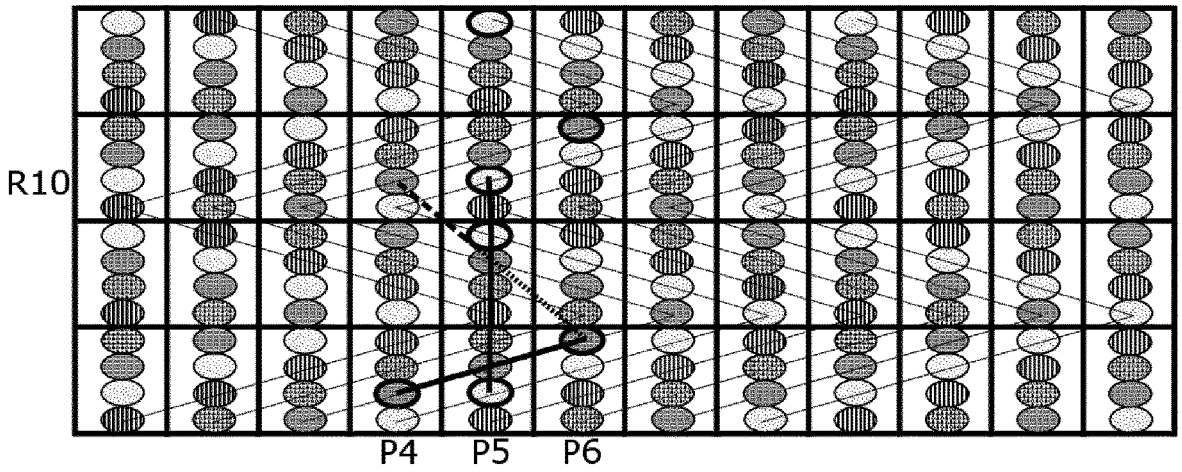

From this point of entanglement E1, the blue yarn then follows the unattached path 227 which swings around as shown in FIG. 13 as the needle bar begins to move back to the right as depicted in position R10 in FIG. 13.

Figure 14:
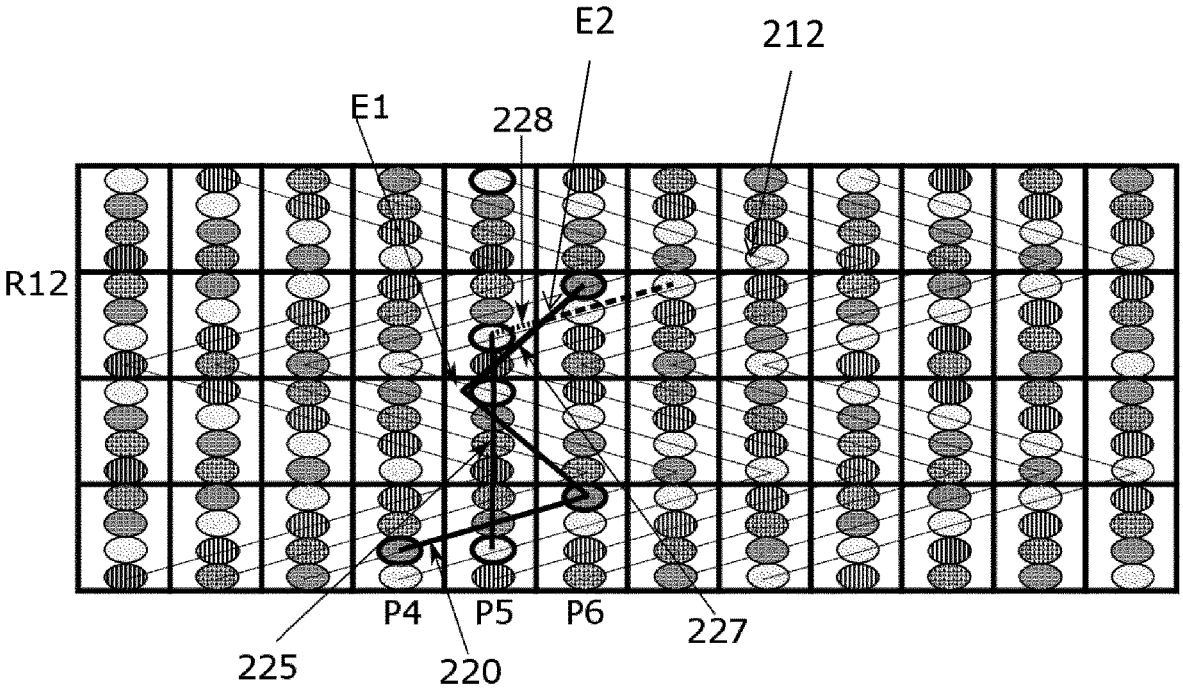

In FIG. 14, at position P6, R12 a further blue tuft 202 is formed. This now anchors the blue yarn on the backside of the backing medium on path 227. In doing so, this traps the white yarn which is following the zigzag path 212 at entanglement point E2.

Figure 15:
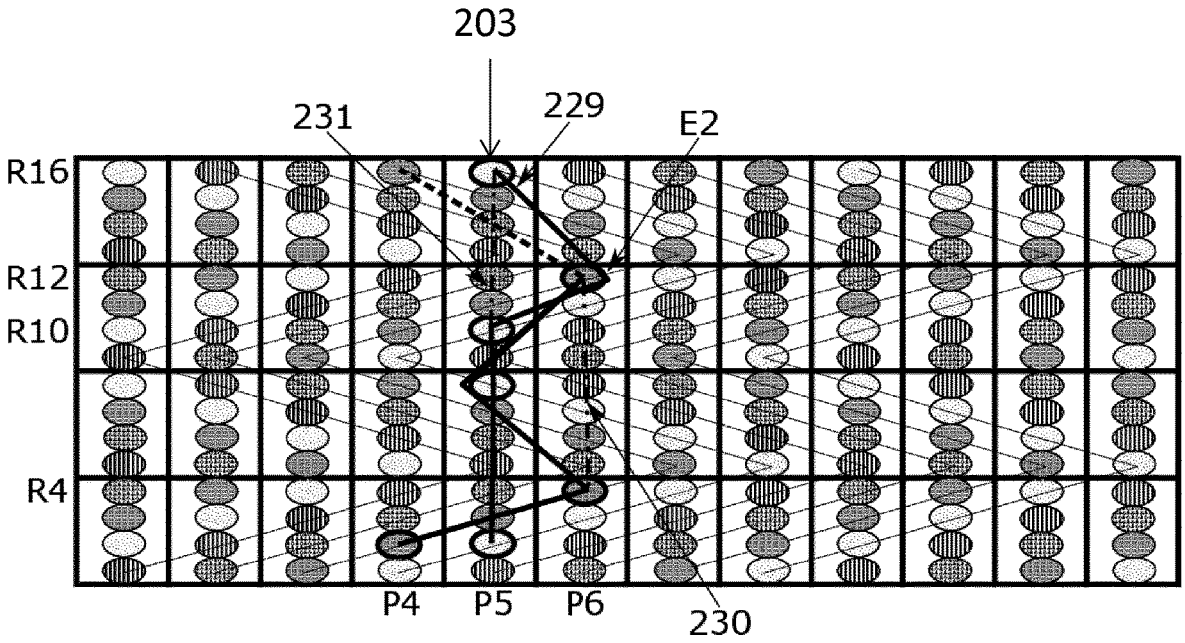

Finally, in relation to FIG. 15, a further white tuft 203 is formed at positon P5, R16. The white yarn now follows path 228 between the points of entanglement E2 at the position P5, R16 as shown by line 229.

If the blue yarn had not become entangled at the point E1, the blue yarn path on the backside of the backing medium would have been straight line from position P6, R4 to position P6, R12 as depicted by the dotted line 230 in FIG. 15. Instead, the blue yarn has travelled via two sides of a triangle along line 226 from points P6, R4 to the first point of entanglement E1, and then along the path 227 from the point of entanglement E1 to the position P6, R2. Given that all of the above described yarn positions are well defined points which are programmed into the controller, it is a matter of simple trigonometry to work out the positions of the points of entanglement (E1, E2) which will not necessarily correspond exactly to a stitch position, and hence calculate the additional amount of yarn required because the yarn has become entangled. This is done by adding lengths of the paths 226 and 227 and subtracting the ideal length of the non-entangled yarn 230.

Similarly, for the white yarn, the path of yarn if it had not become entangled is a straight path from P5, R10 to P5 to R16 as depicted by line 231. Again, the additional yarn required is calculated as the length of the path 228 plus path 239 minus path 231.

The same calculation is repeated from all yarn at all positions and the yarn feed mechanism is then instructed by the controller to feed additional yarn based on this calculation.

The described example includes only one point of entanglement between adjacent tufts. It is perfectly possibly for there to be two or more such points of entanglement. Under these circumstances, it is simply a matter of adding together the path between the two tufts via all points of entanglement and is subtracting the length of the direct path between the two tufts to determine the additional yarn required.

In practice, the controller first determines whether a tuft is formed at a particular position. If it is, there is no need for the controller to determine whether there are any points of entanglement of the yarn. It is only when the controller determines that a tuft is not formed at a particular positon that it then needs to determine whether additional yarn is required to take into account any points of entanglement. In doing so, if the needle bar is moving to the left, the controller needs to check the path of all colours to the right that potentially cross the path of the yarn in question. Similarly, if the needle bar is going to the right the controller needs to check the paths of the yarn to the left. This simplifies the amount of calculations that are required.

As described above, the method is carried out on the assumption that each yarn follows the zigzag paths 210 to 212 as described by the needle bar. However, once a yarn is entangled, it is caused to follow a different path from its associated needle than it would had it not been trapped. As a result of this deviation, each yarn may entangle other yarns in the manner which is different from the manner in which it would have done had it not become entangled. Having calculated the path of the tangled yarn, the software may perform a second iteration of calculations using the newly calculated tangled yarn path instead of the previously used ideal yarn path in order to provide a more accurate calculation of the yarn entanglement. However, this may not be necessary as the first approximation described above may provide sufficient accuracy that this makes no difference in practice to the finished carpet. On the other hand, second and subsequent iteration could be provided to provide further accuracy. Ultimately this is a trade-off between processing power and the degree of accuracy of the tuft length required in the final carpet.

The invention claimed is:

1. A tufting machine comprising:

backing rollers to feed a backing medium through a tufting region in a tufting direction;

a sliding needle bar comprising at least one row of needles and being reciprocable at the tufting region to drive the needles into and out of the backing medium, and being slideable in a direction lateral to the tufting direction;

gauge parts on the back side of the backing medium which is opposite to the needle bar to receive loops of yarn formed by the needles;

a controller which receives pattern data for the carpet to be tufted;

a stitch selection mechanism operated by the controller to allow selection of a yarn of a colour required by the pattern data to form a tuft in the backing medium as it is presented by the needle bar and to prevent formation of a tuft of a colour not required by the pattern data as it is presented by the needle bar;

and a yarn feed mechanism to control the feed of yarns, the amount of yarn fed to each needle being controlled by the controller to provide an amount of yarn required to form the tuft of the desired pile height, and the amount of yarn required for a back stitch;

wherein the controller is configured to determine points of entanglement between different yarns from the pattern data, a point of entanglement being defined as a point where the yarn from one needle crosses and traps the yarn from another needle on the back face of the backing medium; and wherein the controller is configured to calculate an additional length of the back stitch caused by each point of entanglement by subtracting an ideal back stich length, calculated as the path which would have been taken by the yarn had it not been entangled in another yarn, from an actual yarn path, calculated as the actual length of the entangled yarn, the controller adding to the amount of yarn fed by a respective yarn feed mechanism for each stitch an amount equivalent to the additional length of the back stitch.

2. A method of operating a tufting machine comprising:

backing rollers to feed a backing medium through a tufting region in a tufting direction;

a sliding needle bar comprising at least one row of needles and being reciprocable at the tufting region to drive the needles into and out of the backing medium, and being slideable in a direction lateral to the tufting direction;

gauge parts on the back side of the backing medium which is opposite to the needle bar to receive loops of yarn formed by the needles;

a controller which receives pattern data for the carpet to be tufted;

a stitch selection mechanism operated by the controller to allow selection of a yarn of a colour required by the pattern data to form a tuft in the backing medium as it is presented by the needle bar and to prevent formation of a tuft of a colour not required by the pattern data as it is presented by the needle bar;

and a yarn feed mechanism to control the feed of yarns, the amount of yarn fed to each needle being controlled by the controller to provide an amount of yarn required to form the tuft of the desired pile height, and the amount of yarn required for a back stitch;

wherein the controller determines points of entanglement between different yarns from the pattern data, a point of entanglement being defined as a point where the yarn from one needle crosses and traps the yarn from another needle on the back face of the backing medium;

wherein the controller calculates an additional length of back stich caused by each point of entanglement by subtracting an ideal back stitch length, calculated as the path which would have been taken by the yarn had it not been entangled in another yarn, from an actual yarn path, calculated as the actual length of the entangled yarn, and wherein the controller adds to the amount of yarn fed by a respective yarn feed mechanism for each stitch an amount equivalent to the additional length of the back stitch.

* * * * *